US011207762B2

(12) United States Patent
Lownik et al.

(10) Patent No.: US 11,207,762 B2
(45) Date of Patent: Dec. 28, 2021

(54) PIPE WRENCH

(71) Applicant: Milwaukee Electric Tool Corporation, Brookfield, WI (US)

(72) Inventors: Matthew A. Lownik, Milwaukee, WI (US); Aaron S. Blumenthal, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 280 days.

(21) Appl. No.: 16/389,638

(22) Filed: Apr. 19, 2019

(65) Prior Publication Data

US 2019/0299372 A1 Oct. 3, 2019

Related U.S. Application Data

(63) Continuation of application No. PCT/US2019/024955, filed on Mar. 29, 2019.
(Continued)

(51) Int. Cl.
*B25B 13/50* (2006.01)
*B25G 1/04* (2006.01)

(52) U.S. Cl.
CPC ..... *B25B 13/5058* (2013.01); *B25G 1/043* (2013.01)

(58) Field of Classification Search
CPC ... B25B 13/5058; B25B 13/505; B25B 13/46; B25B 13/48; B25B 13/16; B25B 13/12;
(Continued)

(56) References Cited

U.S. PATENT DOCUMENTS 59,852 A 11/1866 McLaren
179,276 A 6/1876 Crosby
(Continued)

FOREIGN PATENT DOCUMENTS

CN 2726826 9/2005
CN 201102213 8/2008
(Continued)

OTHER PUBLICATIONS

International Search Report and Written Opinion for Application No. PCT/US2019/024955 dated Jul. 17, 2019, 14 pages.
(Continued)

*Primary Examiner* — Robert J Scruggs
(74) *Attorney, Agent, or Firm* — Reinhart Boerner Van Deuren s.c.

(57) ABSTRACT

A pipe wrench with an extendible handle is provided. The extendible handle may include a web and a flange to reduce bending stress. The pipe wrench may include a locking button that slides within a channel of the web to lock the extension handle at predetermined extended or retracted lengths. The locking button selectively enables the extension or retraction of the extension handle relative to the first handle of the pipe wrench. The locking button is biased by a spring and coupled to the extension handle with an e-clip. The body, the first handle, and/or the extension handle can include composite materials. In some embodiments, carbon fiber reinforced plastics, fiberglass reinforced plastics, and/or other reinforced polymers are used to form one or more features of the pipe wrench.

23 Claims, 10 Drawing Sheets

Related U.S. Application Data

(60) Provisional application No. 62/650,685, filed on Mar. 30, 2018, provisional application No. 62/793,780, filed on Jan. 17, 2019.

(58) Field of Classification Search
CPC ... B25B 7/02; B25B 13/5008; B25B 13/5025; B25G 1/04; B25G 1/043; B25G 1/06
See application file for complete search history.

(56) References Cited

U.S. PATENT DOCUMENTS 461,769 A 10/1891 Patton
467,151 A 1/1892 Carpenter
483,785 A 10/1892 Hilts
592,031 A 10/1897 Waitt
954,335 A 4/1910 Page
966,300 A 8/1910 Bennett
992,127 A 5/1911 Hachmann
998,271 A 7/1911 Barabe
1,000,724 A 8/1911 Duffey
1,032,035 A 7/1912 Ver Beck
1,074,936 A 10/1913 Evans
1,129,771 A 2/1915 Wolfe
1,163,233 A 12/1915 Haban
1,204,999 A 11/1916 McCord
1,209,002 A 12/1916 Martin
1,288,248 A 12/1918 Snowdon
1,334,392 A 3/1920 Lumpkin
1,345,983 A 7/1920 Bell
1,353,246 A 9/1920 Kiefer
1,356,577 A 10/1920 Wiertz
1,362,845 A 12/1920 Carr
1,380,052 A 5/1921 Fowble
1,395,952 A 11/1921 Fraro
1,449,386 A 3/1923 Evans et al.
1,492,478 A 4/1924 Markovich
1,504,870 A 8/1924 Coughlin
1,542,123 A 6/1925 Eifel
1,563,242 A 11/1925 Tweit
1,565,338 A 12/1925 Thewes
1,589,736 A 6/1926 Bell
1,589,763 A 6/1926 Ratcliff
1,599,399 A 9/1926 Bjornson et al.
1,652,355 A 12/1927 Hammer
1,662,002 A 3/1928 Dowd
1,697,764 A 1/1929 Heinz
1,727,623 A 9/1929 Thewes
1,862,002 A 6/1932 Brungardt
2,063,318 A 12/1936 Larson
2,076,830 A 4/1937 Thewes
2,116,743 A 5/1938 Henderson
2,192,702 A 3/1940 Wright
2,282,148 A 5/1942 Siegund Mandi
2,483,713 A 10/1949 Seaver
2,502,407 A 3/1950 Gordon
2,517,729 A 8/1950 Smith
2,528,814 A 11/1950 Boyer
2,650,512 A 9/1953 Johnson et al.
2,691,317 A 10/1954 Olson
2,696,133 A 12/1954 Burgess
2,700,911 A 2/1955 Dyczynski
2,813,443 A 11/1957 St. Pierre
3,188,894 A * 6/1965 Matsuoka ..... B25B 13/5058 81/101
3,657,949 A 4/1972 Myers
3,802,466 A 4/1974 Panella
3,956,949 A 5/1976 Romano
3,996,820 A 12/1976 Tuell
4,541,313 A 9/1985 Wise
4,572,037 A 2/1986 Jeng-Shyong
4,580,468 A 4/1986 Cox
4,597,315 A 7/1986 Chen
4,825,254 A 4/1989 Moritake et al.
4,831,903 A 5/1989 Dausey et al.
4,903,555 A 2/1990 Howard
5,062,328 A * 11/1991 Demurger ..... B25B 13/08 81/186
5,152,198 A 10/1992 Schmitz, Jr.
5,193,419 A 3/1993 Lee
5,251,518 A 10/1993 Woo
5,331,868 A 7/1994 Elmore
5,392,673 A 2/1995 Scott
5,517,884 A 5/1996 Sanders
5,542,319 A 8/1996 Wei
5,823,076 A 10/1998 Binkowski
5,832,793 A 11/1998 Collins
5,862,722 A 1/1999 Cislo
5,911,798 A * 6/1999 Arnold ..... B25B 13/461 81/177.2
5,927,159 A 7/1999 Yokoyama et al.
5,957,008 A 9/1999 Long
5,960,683 A 10/1999 Malkin et al.
6,026,714 A 2/2000 Chang
6,058,814 A * 5/2000 Johnson ..... B25G 1/043 81/177.2
6,089,129 A 7/2000 Huang
6,098,505 A 8/2000 Chang
6,131,491 A 10/2000 Hirse
D435,410 S 12/2000 Lin
6,167,784 B1 1/2001 Lin
6,257,102 B1 1/2001 Perry
6,223,632 B1 5/2001 Johnson
6,286,396 B1 * 9/2001 Johnson ..... B25B 9/00 81/177.2
6,298,754 B1 10/2001 Brown
6,305,251 B1 10/2001 Pasbrig
6,311,586 B1 11/2001 Hirse
6,334,377 B1 1/2002 Wu
6,336,381 B2 1/2002 McDonnell
6,349,621 B1 2/2002 Khachatoorain
6,393,951 B1 5/2002 Jansson et al.
6,431,033 B1 8/2002 Cheng
6,477,921 B1 11/2002 Picone
D474,380 S 5/2003 Chartier et al.
6,568,283 B2 5/2003 Fanguy
D483,238 S 12/2003 Hsieh
D483,785 S 12/2003 Laituri
6,742,419 B2 6/2004 Chartier et al.
D494,030 S 8/2004 Burry
6,810,775 B2 11/2004 Yang
6,931,969 B2 8/2005 Hsien
6,938,525 B2 9/2005 Poole et al.
6,961,973 B1 11/2005 Smith
6,966,242 B2 11/2005 Picone
6,971,288 B2 12/2005 Wei
7,040,199 B2 5/2006 Gregory
7,044,030 B2 5/2006 Chartier et al.
7,059,221 B2 6/2006 Simon
7,096,764 B2 8/2006 Dong
7,114,824 B2 * 10/2006 Picone ..... B25B 13/14 362/119
7,131,355 B2 11/2006 Williams
D546,148 S 7/2007 Becker
D564,848 S 3/2008 Salazar et al.
D571,172 S 6/2008 Yu
7,472,630 B1 1/2009 Velluzzi
7,546,784 B1 6/2009 Yu
7,578,219 B2 8/2009 Wu
7,882,768 B2 2/2011 Urquizu Osa
D657,213 S 4/2012 Pond et al.
8,176,816 B2 5/2012 Simon
D676,727 S 2/2013 Martin et al.
8,549,961 B2 10/2013 Huang
D869,097 S 12/2019 Brown
2001/0035076 A1 11/2001 Gilbert
2003/0015068 A1 1/2003 Pool et al.
2003/0110905 A1 6/2003 Lacey
2003/0183048 A1 10/2003 Olsen
2004/0237731 A1 12/2004 Ha
2005/0204873 A1 9/2005 Ana
2005/0243553 A1 11/2005 Picone
2006/0053982 A1 3/2006 Mo
2006/0196319 A1 9/2006 Hung et al.

(56) References Cited

U.S. PATENT DOCUMENTS

| | | | | |
|---|---|---|---|---|
| 2007/0074608 | A1 | 4/2007 | Mo | |
| 2007/0125205 | A1 | 6/2007 | Beckwith et al. | |
| 2007/0245861 | A1 | 10/2007 | Shields | |
| 2009/0193940 | A1 | 8/2009 | Kuo | |
| 2009/0217790 | A1 | 9/2009 | Harter | |
| 2010/0050825 | A1* | 3/2010 | May | B25G 3/18 81/177.2 |
| 2010/0122612 | A1 | 5/2010 | Kovach et al. | |
| 2010/0083798 | A1 | 8/2010 | Tai | |
| 2010/0242686 | A1 | 9/2010 | Gower | |
| 2011/0232427 | A1* | 9/2011 | Streater | B25B 13/5033 81/167 |
| 2014/0007744 | A1 | 1/2014 | Watson et al. | |
| 2014/0069238 | A1 | 3/2014 | Chang | |
| 2014/0083260 | A1 | 3/2014 | Kundracik et al. | |
| 2014/0116206 | A1 | 5/2014 | Chartier et al. | |
| 2015/0000476 | A1 | 1/2015 | Li | |

FOREIGN PATENT DOCUMENTS

| | | |
|---|---|---|
| CN | 201511326 | 6/2010 |
| CN | 203210256 | 9/2013 |
| CN | 204431137 | 7/2015 |
| DE | 202006018047 | 3/2007 |
| GB | 711231 | 6/1954 |
| GB | 753198 | 7/1956 |
| JP | 06021856 | 3/1994 |
| KR | 200219607 | 4/2001 |
| TW | 234970 | 11/1994 |
| TW | 309827 | 7/1997 |
| TW | 451783 | 8/2001 |
| TW | 493505 | 7/2002 |
| TW | 501520 | 9/2002 |
| TW | M311538 | 5/2007 |
| TW | M344224 | 11/2008 |
| TW | M440851 | 11/2012 |
| TW | M465252 | 11/2013 |
| TW | M471338 | 2/2014 |
| WO | WO9740964 | 11/1997 |

OTHER PUBLICATIONS

International Search Report and Written Opinion for Application No. PCT/US2014/031880 dated Aug. 29, 2014, 14 pages.

International Search Report and Written Opinion for Application No. PCT/US2015/046847 dated Dec. 4, 2015, 12 pages.

Machine Translation of CN203210256U generated by Patent Translate at http://translationportal.epo.org/emtp/translate/?ACTION=description-retrieval&COUNTRY=CN&ENGINE=google&FORMAT=docdb&KIND=U&LOCALE=en_EP&NUMBER=203210256&OPS=ops.epo.org/3.2&SRCLANG=zh&TRGLANG=en, 12 pages.

* cited by examiner

PIPE WRENCH

CROSS-REFERENCE TO RELATED PATENT APPLICATIONS

The present application is a continuation of International Application No. PCT/US2019/024955, filed Mar. 29, 2019 which claims the benefit of and priority to U.S. Provisional Application No. 62/650,685, filed on Mar. 30, 2018, and U.S. Provisional Application No. 62/793,780, filed on Jan. 17, 2019, which are incorporated herein by reference in their entireties.

BACKGROUND OF THE INVENTION

The present invention relates generally to the field of wrenches, and more particularly to pipe wrenches. The present invention relates specifically to a pipe wrench with an elongated handle to remove or tighten pipe at a head of the pipe wrench. Pipe wrenches use a handle to permit a wrenching action on the head of the tool to tighten or release a fastened joint.

SUMMARY OF THE INVENTION

One embodiment of the invention relates to a pipe wrench. The pipe wrench includes a head, a lower jaw, an upper jaw, an actuator, a handle, and an extension handle. The head includes an aperture. The lower jaw is coupled to the head. The lower jaw includes a plurality of teeth that define a lower contact region. The upper jaw partially extends through the aperture of the head. The upper jaw includes a threaded portion and a plurality of teeth that define an upper contact region. The actuator includes threads that engage with the threaded portion of the upper jaw such that rotation of the actuator moves the upper contact region of the upper jaw relative to the lower contact region of the lower jaw. The handle includes a distal end portion adjacent the head. The handle includes a proximal end portion opposite the distal end portion. The proximal end portion has a bore. The extension handle includes a beam configured to slidably extend and retract through the bore. The beam includes a flange extending in a first direction and a web extending in a second direction. The first direction is different than the second direction.

Another embodiment of the invention relates to a pipe wrench. The pipe wrench includes a head, a lower jaw, an upper jaw, an actuator, a handle, and an extension handle. The head includes an aperture. The lower jaw is coupled to the head. The lower jaw includes a plurality of teeth that define a lower contact region. The upper jaw partially extends through the aperture of the head. The upper jaw includes a threaded portion and a plurality of teeth that define an upper contact region. The actuator includes threads engaged with the threaded portion of the upper jaw such that rotation of the actuator moves the upper contact region of the upper jaw relative to the lower contact region of the lower jaw. The handle includes a distal end portion adjacent the head and a proximal end portion opposite the distal end portion. The proximal end portion has a bore. The extension handle has an I-beam cross-sectional shape. The extension handle is configured to slidably extend and retract through the bore. The extension handle includes flanges extending on either side of a web in a direction transverse to the web.

Another embodiment of the invention relates to a pipe wrench. The pipe wrench includes a head, a lower jaw, an upper jaw, an actuator, a handle, an extension handle, a channel, and a locking button. The head includes an aperture. The lower jaw is coupled to the head. The lower jaw includes a plurality of teeth that define a lower contact region. The upper jaw partially extends through the aperture of the head. The upper jaw includes a threaded portion and a plurality of teeth that define an upper contact region. The actuator includes threads that engage with the threaded portion of the upper jaw such that rotation of the actuator moves the upper contact region of the upper jaw relative to the lower contact region of the lower jaw. The handle includes a distal end portion adjacent the head and a proximal end portion opposite the distal end portion. The proximal end portion has a bore. The extension handle includes an I-beam configured to slidably extend or retract through the bore. The I-beam has flanges extending in a transverse direction on either side of a web. The channel is located within the web of the extension handle. The channel has locking locations interconnected by narrow portions. The locking button is coupled to the handle and extends through the channel of the web. The locking button includes a thick section configured to lock the extension handle through the locking location of the channel and a narrow section configured to traverse the locking button through the narrow portions of the channel.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a pipe wrench are shown. Pipe wrenches are useful to apply a torque to an object (e.g., a pipe). Increasing the length of the lever arm (e.g., the handle) increases the torque the pipe wrench applies. However, a long handle may be unwieldy and may be difficult to store or use in tight areas. In addition, long handles add weight to the pipe wrench. Applicant has found that an adjustable extendible handle allows the operator to select the preferred size of the pipe wrench for the desired application. A fully extended handle increases torque and a fully retracted handle is suitable for storage or working in tight areas.

In some embodiments, an extension handle is non-threadably coupled to the handle and extendible to a plurality of extended and non-extended positions. A locking button selectively enables the extension or retraction of the extension handle relative to the first handle of the pipe wrench. The locking button may pass through a channel of the extension handle to selectively extend or retract the extension handle. In various embodiments, the locking button is biased by a spring and coupled to the extension handle with a hard stop feature. The button and non-threaded extension handle enable efficient extension and retraction. Selective extension of the extension handle enables customization for jobs in narrow or tight environments.

In some embodiments, the extension handle has a web and a flange. The flange extends from the web in a non-parallel direction. For example, a cross-section of the extension handle may be an I-beam. The web further includes a channel that allows a locking button to traverse through the channel and lock the extension handle at locking positions in an extracted and/or retracted position. Using a web and flange provide an efficient mechanism to transmit the bending forces generated on the extension handle and through the primary handle. The use of a button and locking locations provides for selective extension of the extension handle.

In various embodiments, Applicant has found that forming portions of the pipe wrench embodiments discussed herein from a composite material, such as a composite plastic material, provides further weight reduction. The light-weight material remains strong and durable enough to transmit torque to the workpiece. Composite materials are suitable when the extension handle is non-threadably coupled to the first handle and extendible to a plurality of extended and retracted (e.g., non-extended) positions. The teeth are manufactured from a metal (e.g., aluminum or steel) and coupled to composite or other light-weight bodies and/or handles. The body, the handle, and/or the extension handle are formed from steel, aluminum, or a high strength plastic or polymer material, such as Kyron Max (S Series, ES Series, or XS Series), PEEK, Lytex, thermoset plastics, and/or fiber reinforced plastics.

Figure 1:
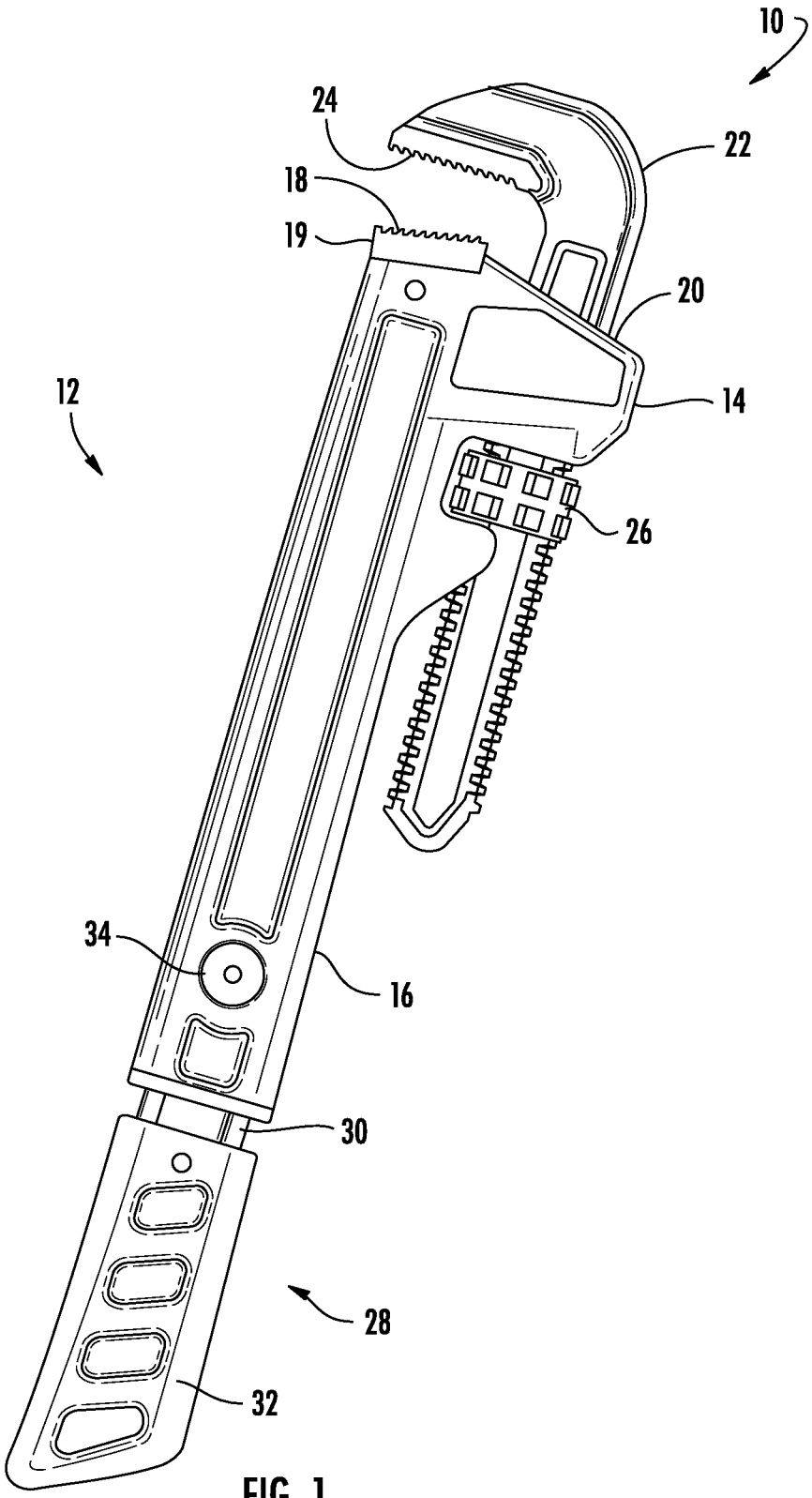
FIG. 1 shows a pipe wrench with an extension handle, according to an exemplary embodiment.
Figure 2:
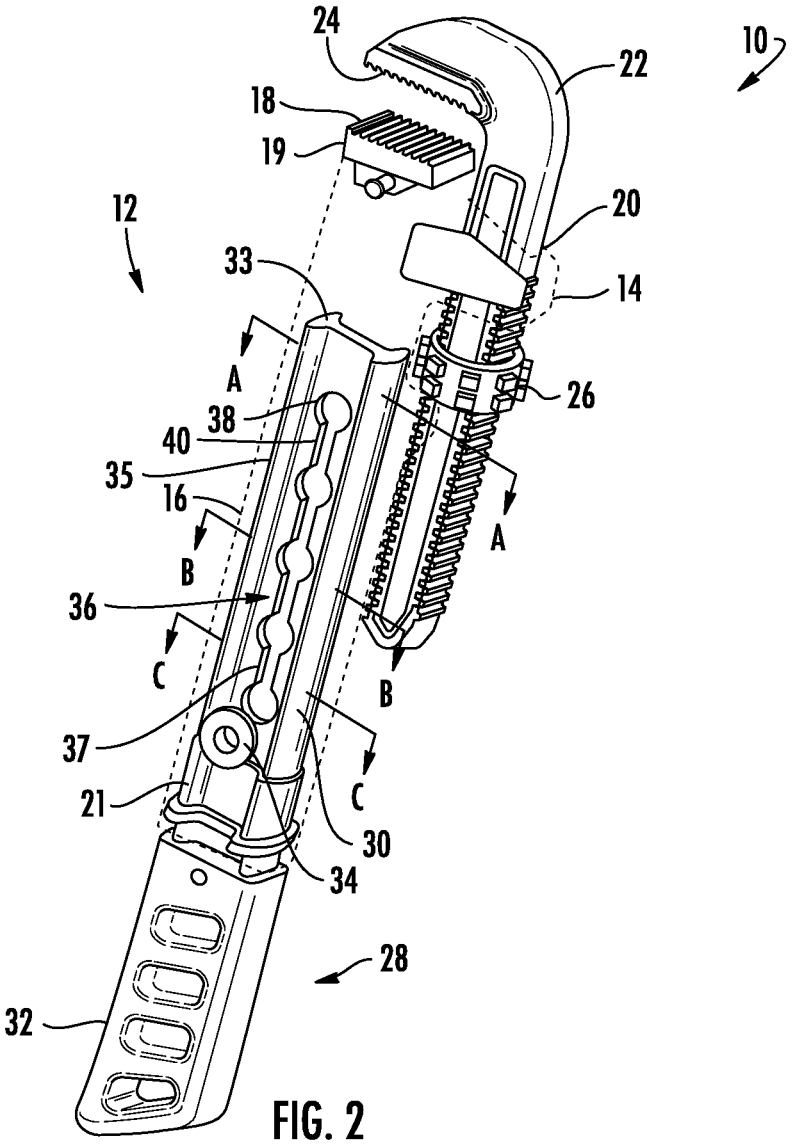
FIG. 2 shows the pipe wrench of FIG. 1, with a primary handle in ghost lines to show the components of the extension handle located within the primary handle, according to an exemplary embodiment.
Figure 3:
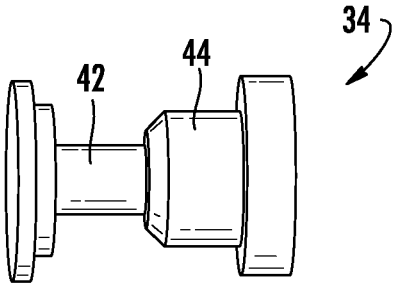
FIG. 3 shows a locking button with two sections, each section having a different cross-sectional diameter, according to an exemplary embodiment.

Referring to FIG. 1, a pipe wrench 10 is shown according to an exemplary embodiment. FIGS. 1-3 illustrate the pipe wrench 10. The wrench 10 includes a body 12 having a head 14 and a primary handle 16. A lower jaw 19 couples to head 14 and includes a first set of teeth 18 (e.g., selectively coupled or fixedly coupled). First set of teeth 18 define a lower contact region or contact plane. Second set of teeth 24 define an upper contact region or contact plane. Head 14 includes an aperture 20 sized to slidably receive an upper or hook jaw 22 having a second set of teeth 24. Head 14 couples lower jaw 19 to hook jaw 22. Hook jaw 22 partially extends through the aperture of the head 14. An actuator or thumb wheel 26 includes threads engaged with the threaded portion of hook jaw 22. Rotating thumb wheel 26 that is threadably coupled to hook jaw 22 the contact region of the second set of teeth 24 moves relative to the contact region of the first set of teeth 18 to cooperate and grip an object (e.g., a nut or a pipe).

Primary handle 16 includes a distal end portion adjacent to head 14 and a proximal end portion opposite the distal end portion. The proximal end portion includes a bore 21. Pipe wrench 10 includes an extension handle 28 on primary handle 16 having an elongated portion 30 received within the bore 21 of primary handle 16 and an end cap 32 coupled to an end of the elongated portion 30. The end cap 32 is located at a proximal end of the extension handle 28 on the elongated portion 30. End cap 32 is configured to receive a hand of an operator to extend and/or retract end cap 32. For example, end cap 32 includes concave recesses and/or holes shaped to receive one or more fingers of an operator's hand. End cap 32 is configured to rotate the elongated portion 30 of extension handle 28 to provide a torque to a workpiece between the first set of teeth 18 and the second set of teeth 24. Extension handle 28 is non-threadably coupled and in some embodiments includes a friction fit and/or a button fit. In some embodiments, extension handle 28 includes threads to couple extension handle 28 to primary handle 16. A locking member or locking button 34 selectively enables the extension or retraction of the extension handle 28 relative to the body 12 of pipe wrench 10. An operator pushes locking button 34 to release extension handle 28 from a locked position. The operator then slidably extends or retracts extension handle 28 into a second locked position by releasing locking button 34. This allows the operator to extend the length of body 12 by extending the elongated portion 30. The longer body 12 increases the applied torque, e.g., on a pipe. The process is reversed to retract the elongated portion 30 for easier storage and handling.

FIG. 2 illustrates pipe wrench 10 with primary handle 16 in shadow lines. Elongated portion 30 defines a beam 33. Beam 33 may have an I-beam 33 cross-section shape. Because of this, extension handle 28 is non-rotatably received within primary handle 16. Beam 33 includes a flange 35 and a web 37. The thickness of flange 35 may be greater than the thickness of the web 37 to improve the bending properties provided by flange 35 surrounding web 37. In other embodiments, web 37 may have the same thickness, or a greater thickness, than flange 35 to increase the shear properties of web 37. The shape and dimensions of beam 33 are selected to reduce bending stresses in beam 33 and increase the torque applied between the first set of teeth 18 on lower jaw 19 and the second set of teeth 24 on hook jaw 22. In addition, the height and length of flange and/or web 37 can be customized for specific applications to maximize the torque distributed at teeth 18 and 24 of pipe wrench 10.

Figure 15:
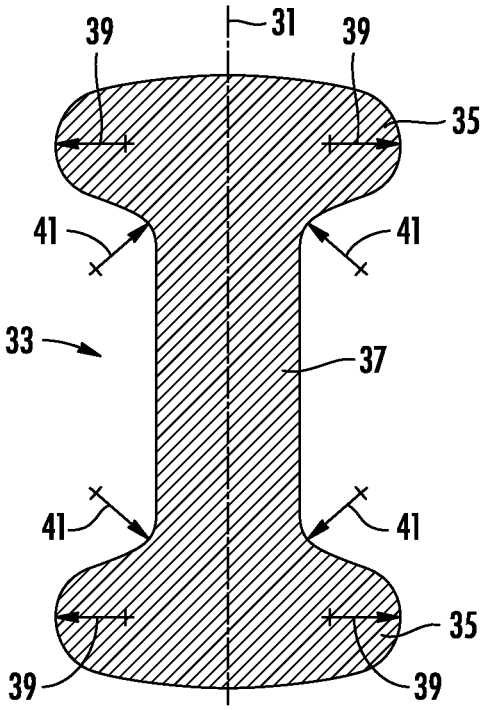
FIG. 15 shows a cross-section view of the I-beam of FIG. 2 along line A-A, according to an exemplary embodiment.

FIG. 15 illustrates an exemplary embodiment of the cross-section of an I-beam 33 taken at line A-A of FIG. 2. The flanges 35 form a convex internal radius 39 that is curved (e.g., the center of internal radius 39 is inside the I-beam 33 cross-section). Web 37 includes a concave external radius 41 (e.g., where the center of the external radius 41 is external to I-beam 33). In this way, no sharp transitions occur in the cross-section of I-beam 33. This embodiment may reduce stress concentration factors (sometimes referred to as stress intensity K) and/or may enable the I-beam 33 to fit within the body of primary handle 16 without reducing the bending capabilities of the primary handle 16. In some embodiments, the cross-sectional shape of the I-beam 33 may induce a friction fit within primary handle 16. For example, the friction fit holds elongated portion 30 within primary handle 16 in a retracted or other position.

As shown in FIG. 15, I-beam 33 is symmetric about a central axis 31 and has a concave web 37 and curved flanges 35. The I-beam 33 has flanges 35 that extend in a transverse direction on either side of web 37. In some embodiments, flanges 35 and/or web 37 form rectangular cross-sectional shapes forming sharp corners (e.g., internal radius 39 and/or external radius are small). Beam 33 may include only one flange 35 (e.g., a T-beam cross-sectional shape). In some embodiments, beam 33 is asymmetric. For example, web 37 has a larger external radius 41 on a first side of the central axis 31 than a second side. Flange 35 may extend further on a first side of central axis 31 than a second side. For example, beam 33 may take a C-beam or Z-beam cross-sectional shape. The various cross-section embodiments can alter the structural capabilities of the primary handle 16 and/or elongated portion 30. The various shapes may be customized for a particular application in order to minimize the bending stress and maximize the distributed torque.

In some embodiments, beam 33 has a flange 35 (e.g., one or more flanges 35) extending in a first direction and a web 37 extending in a second direction different from the first direction. For example, flange 35 extends from web 37 to form a cross-section comprising a central axis 31 extending through the web 37 and the flange 35. Flange 35 extends through central axis 31. In some embodiments, beam 33 comprises two flanges 35 on either side of the web 37 that extend in a transverse direction through the central axis 31. Flanges 35 extend from central axis 31 in one or more directions. The directions may be the same (e.g., a C-beam) or opposed (e.g., T-beam or Z-beam). In some embodiments, beam 33 is an I-beam 33. In some embodiments, head 14 and primary handle 16 form a continuous integral component and beam 33 is extruded to form the flange 35 and the web 37 as a continuous integral beam 33.

Figure 16:
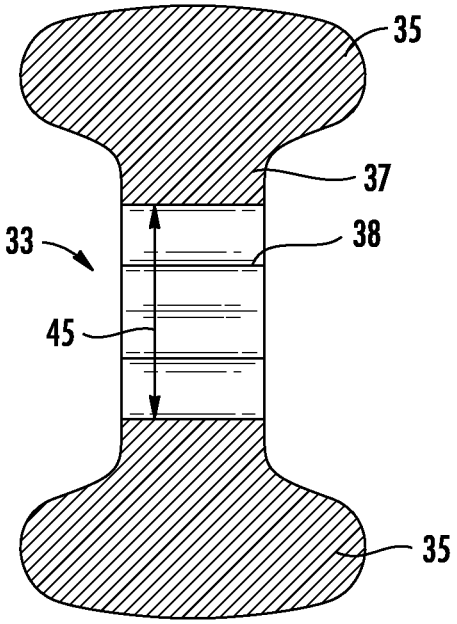
FIG. 16 shows a cross-section view of the I-beam of FIG. 2 along line B-B, according to an exemplary embodiment.
Figure 17:
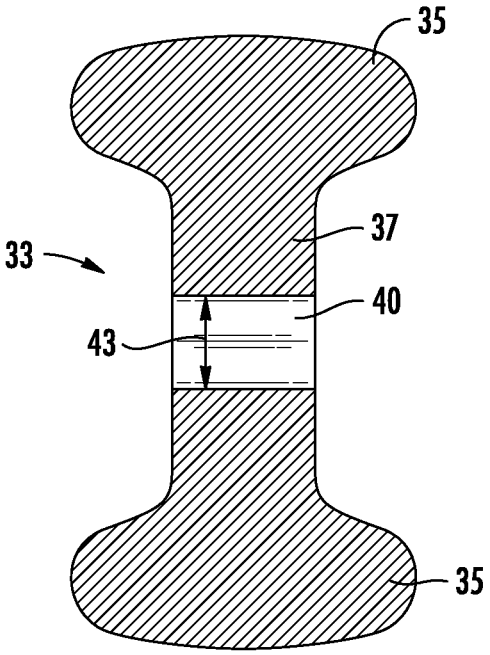
FIG. 17 shows a cross-section view of the I-beam of FIG. 2 along line C-C, according to an exemplary embodiment.

FIGS. 16 and 17 illustrate the cross-section of I-beam 33 illustrated in FIG. 2 at lines B-B and C-C, respectively. With reference to FIG. 2 web 37 of elongated portion 30 of extension handle 28 includes an open section or channel 36. Channel 36 is formed with locking locations 38 (larger openings) interconnected by narrow portions 40 (smaller portions interconnecting the larger openings). Narrow portions 40 have a smaller cross-sectional distance 43 than the cross-sectional distance 45 of locking locations 38.

Locking button 34 is coupled to the primary handle 16 and traverses the elongated portion 30 to selectively lock the extension handle 28 relative to the primary handle 16 in a plurality of positions. In the illustrated embodiment, the locking button 34 is slidably coupled to the primary handle 16 along an axis substantially perpendicular to a longitudinal axis of primary handle 16.

For example, narrow portions 40 of web 37 are configured to receive a thin section 42 (FIGS. 3-5) of locking button 34, but be too small or narrow to receive a thick section 44 of locking button 34. The wide portion or locking location 38 receives the thick section 44 of the locking button 34 to fix extension handle 28 relative to primary handle 16 (e.g., locked in an extended position). When locking button 34 is locked in a locking location 38 of elongated portion 30, extension handle 28 extends a fixed distance from primary handle 16.

With reference to FIGS. 2-3, upon actuation of locking button 34 in a first direction, a first portion or thin section 42 (FIG. 3) of locking button 34 aligns within narrow portions 40 of channel 36 to allow thin section 42 to move between locking locations 38 and narrow portions 40 as extension handle 28 moves relative to primary handle 16. In other words, thin section 42 includes a smaller dimension than narrow portions 40 to permit locking button 34 to move along channel 36 and allowing extension handle 28 to move relative to primary handle 16.

Once a desired position of extension handle 28 relative to primary handle 16 is reached, locking button 34 is moved in a second direction opposite the first direction to position a second portion or thick section 44 (FIG. 3) of locking button 34 within one of the locking locations 38 of channel 36. Thick section 44 includes a greater dimension than narrow portions 40 of channel 36 so that when thick section 44 is positioned within one of the locking locations 38, extension handle 28 is locked relative to primary handle 16. Thick section 44 has a cross-sectional size that is too large to move through narrow portions 40, but locks in locking locations 38. In some embodiments, locking button 34 is biased in the second direction into a locking location 38.

In some embodiments, pipe wrench 10 includes locking button 34 coupled to primary handle 16. Locking button 34 extends through channel 36 of web 37 on extension handle 28. Channel 36 has a cross-sectional first distance 43 or width at narrow portions 40. Channel 36 has a cross-sectional second distance 45 or width at locking locations 38. Second distance 45 is larger than first distance 43. Locking button 34 includes a thick section 44 with a first diameter and a thin section 42 with a second diameter. In some embodiments, the first diameter is greater than the second diameter. Thick section 44 is configured to lock extension handle 28 through a locking location 38 of channel 36. Thin section 42 is configured to traverse narrow portion 40 of locking button 34 through narrow portion 40 of channel 36 to the interconnected locking locations 38.

Figure 4:
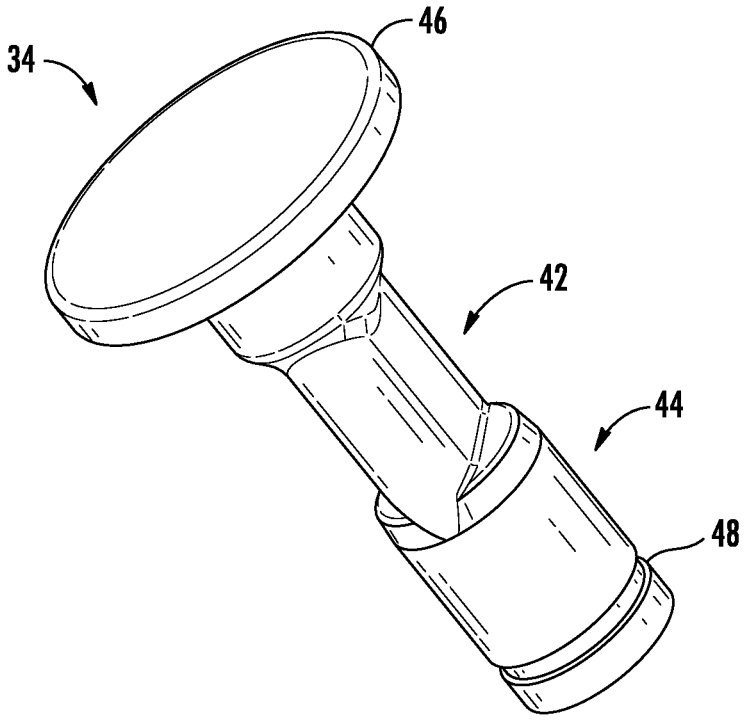
FIG. 4 shows a locking button that includes a head, an ovular thin section, a circular thick section, and an e-clip receiver, according to an exemplary embodiment.

In the embodiment of FIG. 3, locking button 34 includes a first circular thin section 42 and a second circular thick section 44. The cross-sectional diameter of first circular thin section 42 is less than a second cross-sectional diameter of second circular thick section 44. In the embodiment of FIG. 4, locking button 34 includes an ovular thin section 42 and a circular thick section 44. In some embodiments, ovular narrow section 42 has the same diameter as circular thick section 44, with a different cross-sectional width in different directions. The width defines two sides that are cut-out from the circumference to form ovular thin section 42. This facilitates manufacture of locking button 34 and decreases the size of locking button 34.

Figure 5:
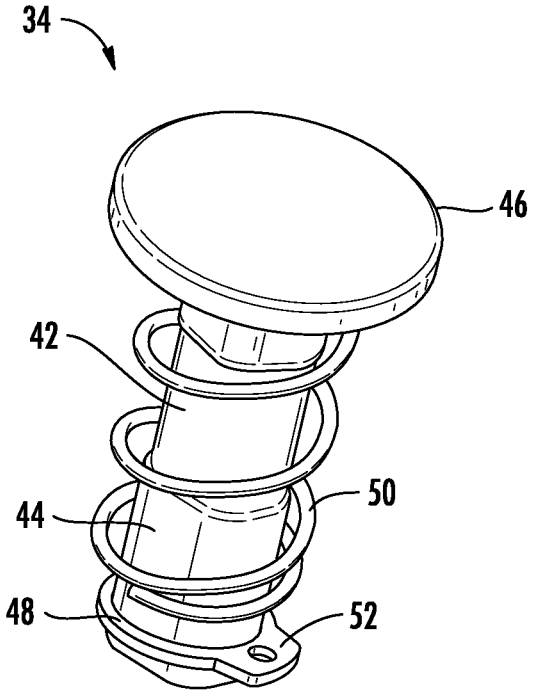
FIG. 5 shows the locking button of FIG. 4 with an attached e-clip and spring, according to an exemplary embodiment.

FIG. 4 shows an isolated view of locking button 34. FIG. 5 shows an isolated view of locking button 34, a spring 50, and an e-clip 52. In the illustrated embodiments of FIGS. 4-5, locking button 34 includes an ovular thin section 42, a circular thick section 44, a top 46, and an e-clip receiver 48. Locking button 34 may take different shapes or forms. The ovular thin section 42 allows locking button 34 to have a similar cross-sectional shape as circular thick section 44 in a first cross-sectional direction (best illustrated in FIG. 5) but have a narrow or smaller thin section 42 in a second cross-sectional direction that can pass easily through narrow portions 40 of channel 36. Circular thick section 44 is configured to lock in locking locations 38 of channel 36. Thin section 42 (in the second direction) is configured to permit locking button 34 to traverse narrow portion 40 of web 37. Thick section 44 is configured to secure locking button 34 within a locking location 38 of web 37.

In some embodiments, locking button 34 includes a biasing member or spring 50 and e-clip 52. When properly aligned over a locking location 38 of channel 36, spring 50 biases locking button 34 providing a force on locking button 34 to secure locking button 34 within a locking location 38 of channel 36. This bias forces circular thick section 44 into locking location 38 of channel 36. E-clip 52 is slidably coupled to e-clip receiver 48 section of locking button 34. Coupling e-clip 52 to locking button 34 retains locking button 34 within channel 36 when a biasing force from spring 50 is applied. In some embodiments, e-clip 52 and/or e-clip receiver 48 may include, or be substituted by, a hard stop feature such as a bolt, a c-clip, an upset post end, or an elongated or different shaped hard stop feature at the end of e-clip 52.

Figure 6:
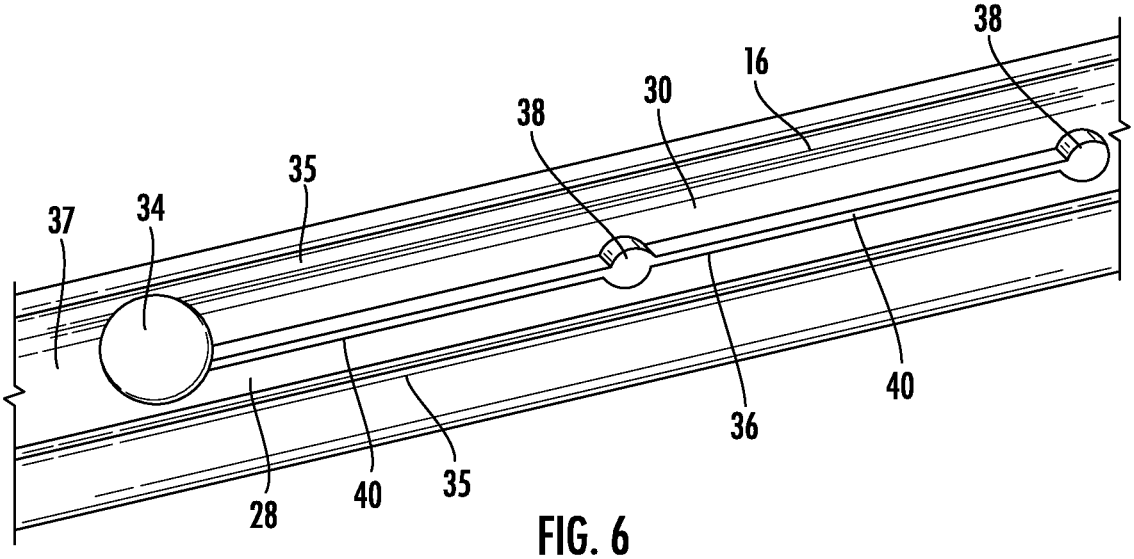
FIG. 6 shows the locking button of FIG. 4 disposed within a channel of the extension handle, the primary handle and outer housing being removed, according to an exemplary embodiment.

FIG. 6 illustrates locking button 34 within channel 36 of web 37. The surface of primary handle 16 is removed to illustrate locking button 34 within extension handle 28 of elongated portion 30. The narrow portions 40 interconnect locking locations 38 of channel 36. In operation, an operator depresses locking button 34 to slide ovular thin section 42 of locking button 34 through narrow portions 40 of channel 36. At a locking position (e.g., locking location 38), the operator releases locking button 34 and spring 50 locks circular thick section 44 into circular locking location 38. In this way, the operator extends or retracts elongated portion 30 and locks extension handle 28 into a fixed position.

Figure 7:
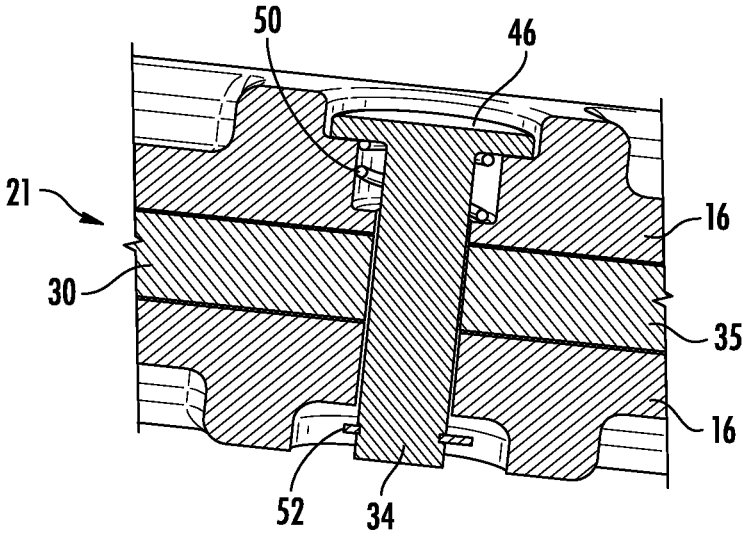
FIG. 7 shows a cross-section of the push button within the primary or outer handle and the extension or inner handle, according to an exemplary embodiment.

FIG. 7 is a cross-sectional view of the locking button 34 within the outer or primary handle 16 and passing through the inner, sliding handle or elongated portion 30. In the illustrated embodiment, locking button 34 is depressed and ovular thin section 42 is within elongated portion 30. Spring 50 is compressed and e-clip 52 is away from a surface of primary handle 16. In this configuration, ovular thin section 42 may slide through narrow portions 40 of channel 36. When locking button 34 is released, spring 50 decompresses, forcing circular thick section 44 of locking button 34 into the locking location 38 of channel 36. In this configuration, e-clip 52 rests along an opposing surface of primary handle 16 to retain locking button 34.

Figure 8:
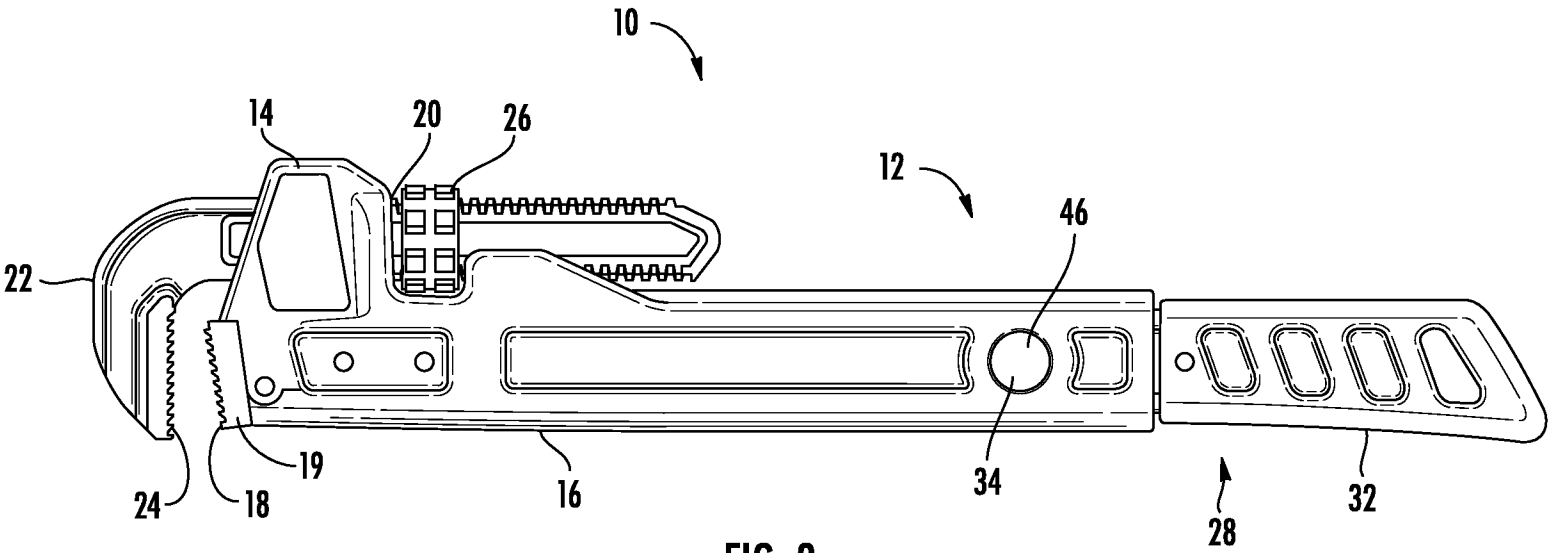
FIG. 8 shows a top view of an extendible pipe wrench with a locking button, according to an exemplary embodiment.
Figure 9:
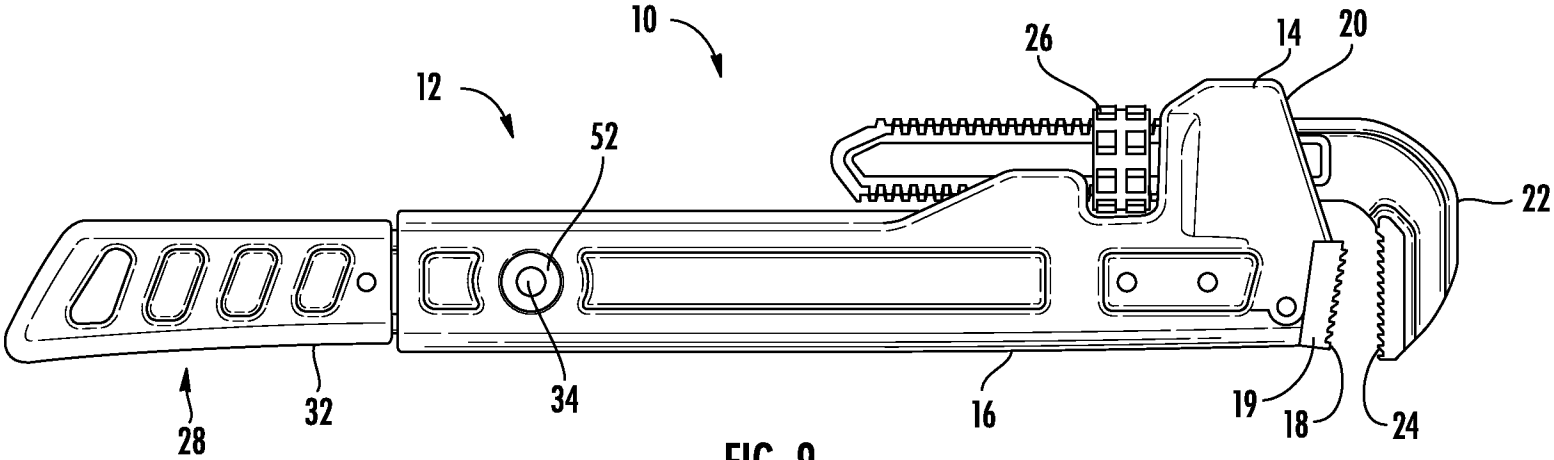
FIG. 9 shows a bottom view of an extendible pipe wrench illustrating the bottom of the locking button coupled to an e-clip, according to an exemplary embodiment.

FIG. 8 illustrates a top view of pipe wrench 10. Top 46 of locking button 34 is visible. In the illustrated configuration, extension handle 28 is returned to a retracted position within primary handle 16 to reduce the total length of pipe wrench 10. Locking button 34 is in a locked position preventing extension of elongated portion 30 (FIG. 2). To extend the total length of pipe wrench 10, the operator depresses locking button 34 and pulls extension handle 28. Now extended, pipe wrench 10 creates a lever-like action that increases applied torque between lower jaw 19 and hook jaw 22 of pipe wrench 10. The retracted pipe wrench 10 (FIGS. 8-9) is useful for portability and storage. FIG. 9 shows the bottom of pipe wrench 10 in FIG. 8. This view illustrates the bottom of locking button 34 and illustrates e-clip 52 that retains locking button 34 within primary handle 16 and through channel 36 of the elongated portion 30. In this way, locking button 34 couples and locks extension handle 28 relative to primary handle 16.

Figure 10:
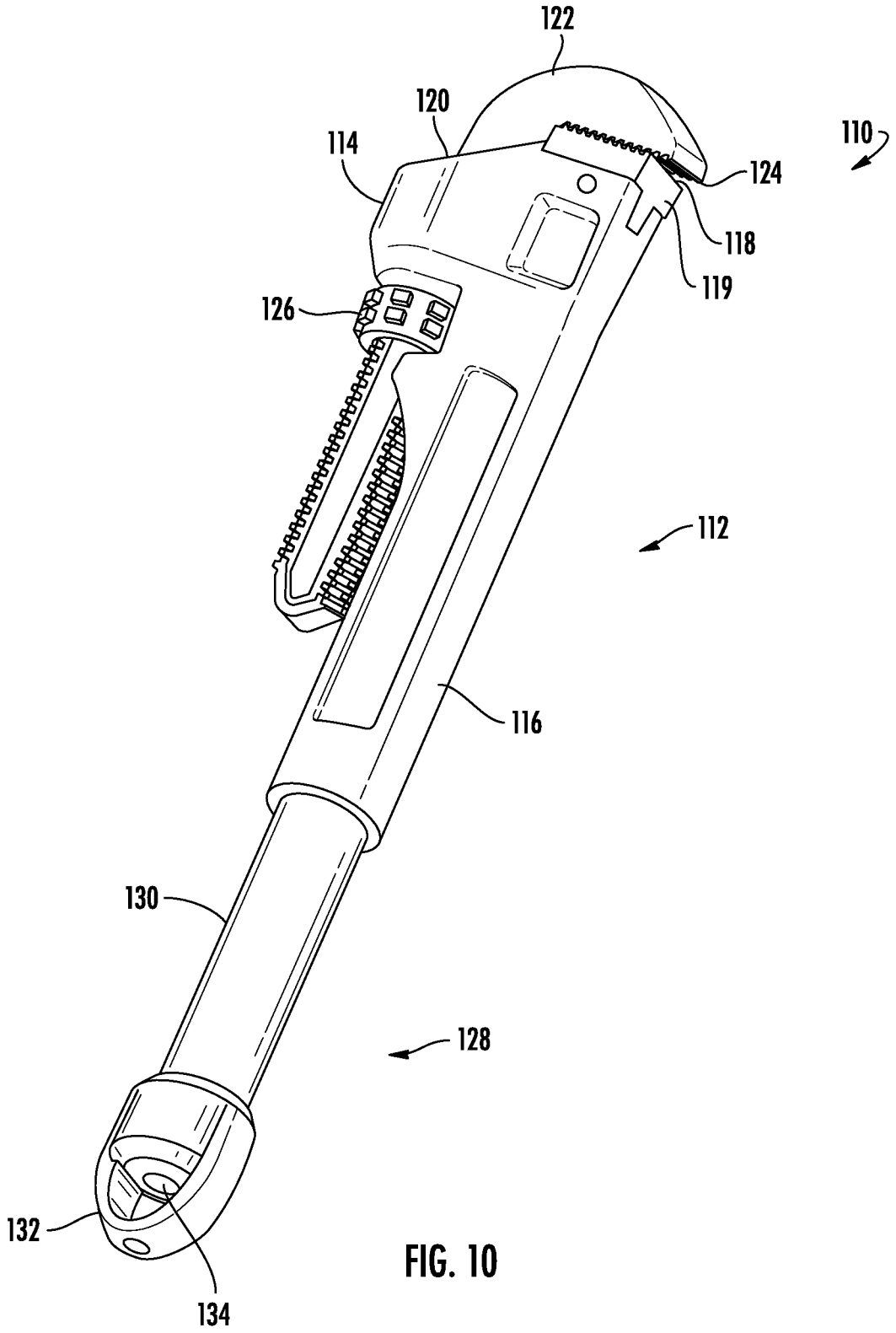
FIG. 10 shows a pipe wrench with an extension handle, according to another embodiment.
Figure 11:
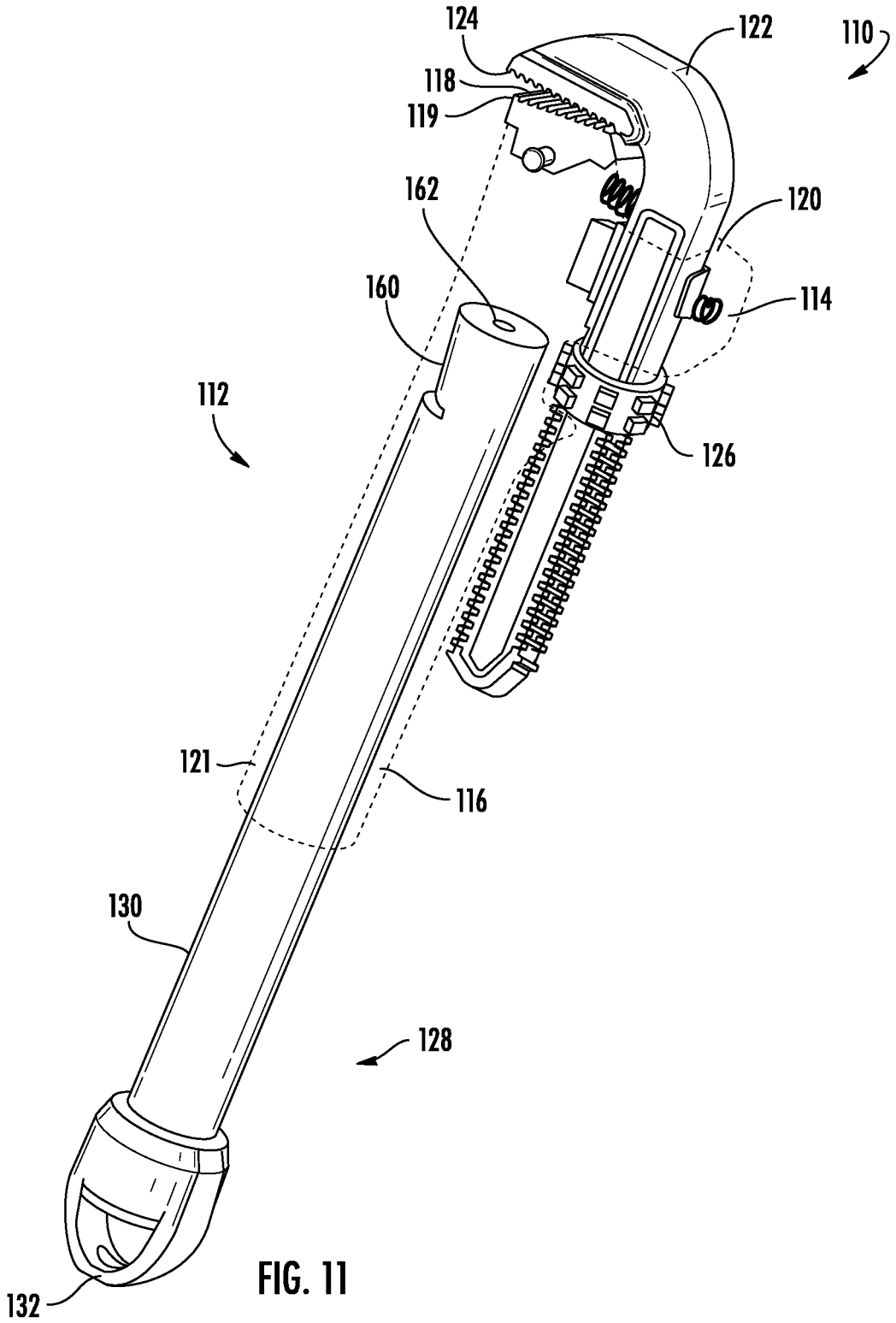
FIG. 11 shows the pipe wrench of FIG. 10, with a primary handle in ghost lines to depict the components of the extension handle within the primary handle, according to an exemplary embodiment.

FIGS. 10 and 11 illustrate a pipe wrench 110 according to another embodiment. Pipe wrench 110 is the same as or similar to pipe wrench 10 except for the differences described. In contrast to the design of pipe wrench 10, the pipe wrench 110 uses a friction fit. Similar components of pipe wrench 110 are designated with similar references numbers as pipe wrench 10, but incremented by 100. Components or features described with respect to only one or some of the embodiments described herein are equally applicable to any other embodiments.

Pipe wrench 110 includes a body 112 having a head 114 and a primary handle 116. Lower jaw 119 is coupled to head 114 and includes a first set of teeth 118. Head 114 includes an aperture 120 sized to receive a hook jaw 122 having a second set of teeth 124. Pipe wrench 110 also includes a thumb wheel 126 operable to move hook jaw 122 relative to head 114.

Pipe wrench 110 also includes an extension handle 128 having an elongated portion 130 and an end cap 132. Elongated portion 130 defines a substantially circular shaped cross-section. As described above with reference to pipe wrench 10, the embodiment of pipe wrench 110 can use other symmetric circular cross-sections 133. For example, an I-beam 33 modified with a large surrounding radius that surrounds the outer extremities of flanges 35 (FIG. 15). Similarly a modified T-shaped or C-shaped beam may form a friction fit within elongated portion 130. In some embodiments, the cross-section is asymmetric. A circular cross-section 133 permits extension handle 128 to rotate within primary handle 116. Other configurations may be used to rotate extension handle 128 within primary handle 116. In some embodiments, circular cross-section 133 includes a tapering wedge 160 located opposite end cap 132 (FIG. 5). Pipe wrench 110 further includes a locking button 134 (FIG. 4) coupled to end cap 132. In the illustrated embodiment, locking button 134 is slidably coupled to end cap 132 along an axis substantially parallel to the longitudinal axis of primary handle 116. Locking button 134 and wedge 160 are coupled together by a rod 162 within wedge 160 and extending through extension handle 128.

Upon actuation of locking button 134 in a first direction (toward the elongated portion 130), rod 162 moves wedge 160 to align wedge 160 within bore 121 of primary handle 116 such that a gap forms between wedge 160 and bore 121 allowing extension handle 128 to move (e.g., extend and/or retract) relative to primary handle 116.

When the operator releases locking button 134, rod 162 tilts wedge 160 within primary handle 116 for a wide end of wedge 160 to form a friction fit (e.g., be wedged) within primary handle 116, thereby locking extension handle 128 relative to primary handle 116.

Figure 12:
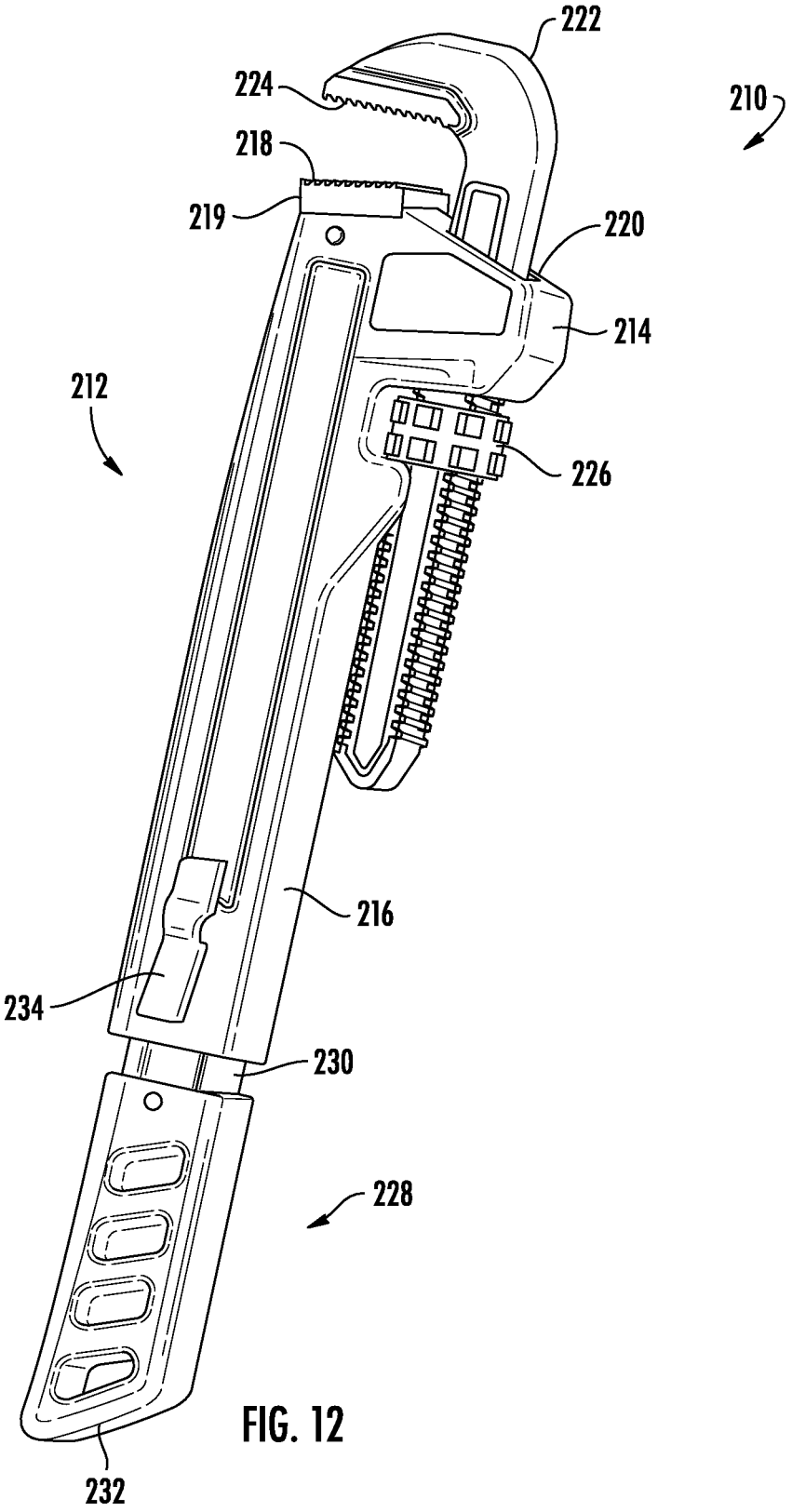
FIG. 12 shows a pipe wrench with an extension handle, according to another exemplary embodiment.
Figure 13:
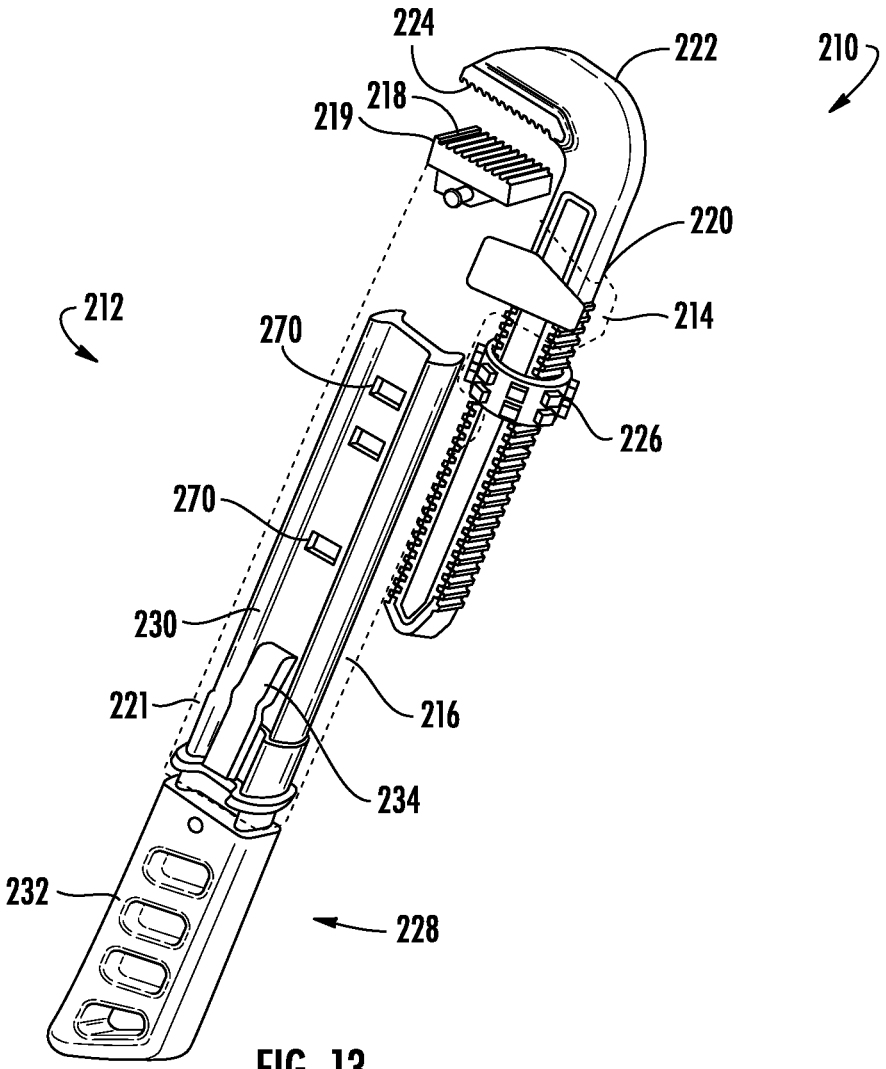
FIG. 13 shows the pipe wrench of FIG. 12, with the primary handle in ghost-lines to depict the components of the extension handle within the primary handle, according to an exemplary embodiment.
Figure 14:
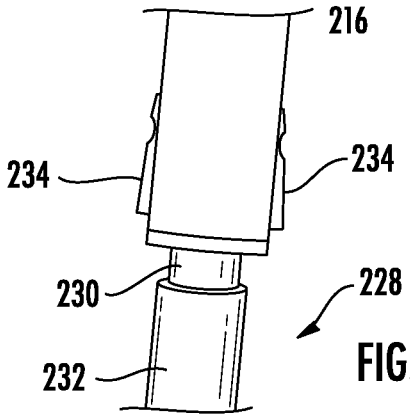
FIG. 14 shows a side view of a portion of the pipe wrench of FIG. 12, according to an exemplary embodiment.

FIGS. 12-14 illustrate a pipe wrench 210 according to another embodiment. Pipe wrench 210 is the same as or similar to pipe wrench 10 and pipe wrench 110, except for the differences described. In contrast to the design of pipe wrench 10 and pipe wrench 110, pipe wrench 210 uses locking members 234 on the sides of primary handle 216 and/or elongated portion 230 to lock extension handle 228. Similar components are designated with similar references numbers incremented by 200. Components or features described with respect to only one or some of the embodiments described herein are equally applicable to any other embodiments described herein.

Pipe wrench 210 includes a body 212 having a head 214 and a primary handle 216. Lower jaw 219 couples to head 214 and includes a first set of teeth 218. Head 214 includes an aperture 220 sized to receive a hook jaw 222 having a second set of teeth 224. Pipe wrench 210 also includes a thumb wheel 226 operable to move hook jaw 222 relative to head 214.

Pipe wrench 210 further includes an extension handle 228 having an elongated portion 230 with a plurality of apertures 270 (FIG. 7) and an end cap 232. Pipe wrench 210 includes levers or locking members 234 pivotably coupled to opposite sides of primary handle 216 and/or elongated portion 230. In other embodiments, pipe wrench 210 can include one locking member 234 coupled to one side of the primary handle 216 and/or elongated portion 230, or the pipe wrench 210 can include more than two locking members 234.

As shown in FIGS. 12-14, when an operator actuates or depresses locking members 234 they disengage from extension handle 228 to allow extension handle 228 to move relative to primary handle 216. Locking members 234 surround or attach on one or more sides of elongated portion 230 such that locking members 234 do not extend significantly beyond primary handle 216 (FIG. 8), thereby reducing unwanted actuation of locking members 234.

When the operator releases locking members 234, locking members 234 are biased to couple with extension handle 228 and lock within apertures 270. The coupling of locking members 234 within detents or apertures 270 of extension handle 228 locks extension handle 228 relative to primary handle 216. As shown in FIGS. 12-14, locking members 234 are disposed on primary handle 216 and apertures 270 are disposed on extension handle 228. In some embodiments, locking members 234 are disposed on extension handle 228 and apertures 270 are disposed on primary handle 216. In some embodiments, lever locking member 234 is pivotably coupled to primary handle 16 and lever locking member 234 is configured to lock within detents or apertures 270 of extension handle 228.

The materials used to construct pipe wrench 10 may include aluminum, titanium, or steel alloys (e.g., 7075 aluminum). In this application, pipe wrench 10 is generally referenced, but the description applies to any pipe wrench embodiment discussed herein, (e.g., pipe wrench 10, 110, and/or 210). In various embodiments, pipe wrench 10 includes metal and plastic components. For example, with reference to FIG. 1, body 12, head 14, primary handle 25, are a plastic constituent and first set of teeth 18, hook jaw 22 and second set of teeth 24 are metallic. The internal elongated portion 30 within pipe wrench 10, contributes to the total weight of pipe wrench 10. Other materials may reduce the weight of the assembled pipe wrench 10. For example, primary handle 16, extension handle 28, elongated portion 30, and/or other components of pipe wrench 10 may be constructed from plastic and/or fiber and joined to a metallic first set of teeth 18 assembly and a metallic hook jaw 22 including a metallic second set of teeth 24.

In a specific embodiment, body 12 includes a non-metallic reinforced plastic and/or fiber constituent. Various components of body 12 can include a carbon fiber, composite plastic, and/or fiberglass material. For example, head 14, primary handle 16, extension handle 28, elongated portion 30, and/or end caps 32 may include a non-metallic material, such as carbon fiber reinforced plastic. A plastic constituent may be reinforced with fiber (e.g., carbon fiber). The plastic constituent may include polyether ether ketones (PEEK), polyphenylene sulfide (PPS), polyetherimide (PEI), polyethylenimine (PEI), polyphthalamide (PPA), polyamide (PA), 60% GF nylon, Lytex™, or other thermoplastics, and/or other polymers. The non-metallic reinforcing constituent may include carbon fiber, fiberglass, glass, nylon fibers, and/or MAX fibers (e.g., as provided by Kyron MAX products). Other low weight materials include Kyron-MAX™ products, such as the S series™, ES Series™, and XS Series™, commercially available from Piper Plastics. Other carbon fiber reinforced plastics (CFRP), glass reinforced plastics (e.g., fiberglass), or other fiber reinforced plastics may generate high practical toughness and reduce total weight of pipe wrench 10.

In some embodiments metallic and non-metallic components may be coupled to one another. For example, head 14, primary handle 16, extension handle 28, elongated portion 30, and/or end caps 32 may include a non-metallic material, such as carbon fiber reinforced plastic and lower jaw 19 and upper or hook jaw 22 comprise a die-forged steel, while I-beam 33 comprises a steel, a titanium, and/or an aluminum alloy. In some embodiments, head 14, primary handle 16, and a part of extension handle 28 are formed from a polymer material and lower jaw 19, hook jaw 22, beam 33, flange 35, and/or web 37 are formed from a metal material.

In a specific embodiment, non-metallic reinforcing constituent forms a material with a tensile strength equal to or greater than 50 ksi (345 MPa) and a tensile modulus of equal to or greater than 5 million psi (35 GPa). In another embodiment, the non-metallic material has a tensile strength of 50-75 ksi (345-517 MPa) and a tensile modulus of 5-8 million psi (35-55 GPa). In another embodiment, the fiber reinforced plastic material has a tensile strength of 75-120 ksi (517-827 MPa) and a tensile modulus of 8-12 million psi (55-83 GPa).

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A pipe wrench, comprising:

a head comprising an aperture;

a lower jaw coupled to the head, the lower jaw comprising a plurality of teeth that define a lower contact region;

an upper jaw partially extending through the aperture of the head, the upper jaw comprising a threaded portion and a plurality of teeth that define an upper contact region;

an actuator comprising threads engaged with the threaded portion of the upper jaw such that rotation of the actuator moves the upper contact region of the upper jaw relative to the lower contact region of the lower jaw;

a handle comprising a distal end portion adjacent the head and a proximal end portion opposite the distal end portion, the proximal end portion comprising a bore; and an extension handle comprising a beam configured to slidably extend and retract through the bore, the beam comprising a flange extending in a first direction and a web extending in a second direction, wherein the first direction is different than the second direction.

2. The pipe wrench of claim 1, further comprising an end cap at a proximal end of the extension handle, the end cap comprising concave recesses shaped to receive one or more fingers of an operator's hand.

3. The pipe wrench of claim 1, wherein the extension handle is non-threadably coupled to the handle.

4. The pipe wrench of claim 1, wherein the flange extends from the web to form a cross-section comprising a central axis extending through the web and the flange and the flange extends through the central axis.

5. The pipe wrench of claim 4, wherein the beam comprises two flanges on either side of the web that extend in a transverse direction through the central axis, wherein the flanges extend from the central axis in both directions.

6. The pipe wrench of claim 1, wherein the head and the handle form a continuous integral component and the beam is extruded to form the flange and the web as a continuous integral beam.

7. The pipe wrench of claim 1, wherein the head, handle, and a part of the extension handle are formed from a polymer material and the lower jaw, the upper jaw, the flange, and the web are formed from a metal material.

8. The pipe wrench of claim 1, further comprising one or more lever locking members pivotably coupled to an outer surface of the handle, the lever locking members configured to fit within detents of the extension handle to lock the extension handle.

9. The pipe wrench of claim 8, wherein the outer surface of the handle includes one or more side surfaces and wherein one or more lever locking members couple to the side surfaces such that the lever locking members do not extend beyond the proximal end portion of the handle.

10. The pipe wrench of claim 8, wherein the one or more lever locking members further include a first end configured to fit within detents of the extension handle and a second end, opposing the first end.

11. The pipe wrench of claim 1, further comprising a channel within the web of the extension handle, the channel comprising locking locations with a first width interconnected by narrow portions with a second width, wherein the first width is greater than the second width.

12. The pipe wrench of claim 11, further comprising a locking button coupled to the handle and extending through the channel of the web on the extension handle, the locking button comprising a thick section that has a first diameter configured to lock the extension handle through the locking location of the channel and a narrow section extending from the thick section and having a second diameter configured to traverse through the narrow portions of the channel, wherein the first diameter of the thick section is greater than the second diameter of the narrow portion.

13. A pipe wrench, comprising:

a head comprising an aperture;

a lower jaw coupled to the head, the lower jaw comprising a plurality of teeth that define a lower contact region;

an upper jaw partially extending through the aperture of the head, the upper jaw including a threaded portion and a plurality of teeth that define an upper contact region;

an actuator comprising threads engaged with the threaded portion of the upper jaw such that rotation of the actuator moves the upper contact region of the upper jaw relative to the lower contact region of the lower jaw;

a handle comprising a distal end portion adjacent the head and a proximal end portion opposite the distal end portion, the proximal end portion comprising a bore; and an extension handle comprising an I-beam cross-sectional shape, the extension handle configured to slidably extend and retract through the bore, the extension handle comprising flanges extending on either side of a web in a direction transverse to the web.

14. The pipe wrench of claim 13, wherein the flanges are rectangular in cross-sectional shape.

15. The pipe wrench of claim 13, wherein the cross-section of the I-beam is symmetric about a central axis and has a concave web, wherein the flanges are curved.

16. The pipe wrench of claim 13, further comprising an end cap at a proximal end of the extension handle, the end cap configured to receive an operator's hand to extend or retract the end cap.

17. The pipe wrench of claim 13, wherein the head, handle, and a part of the extension handle comprise a fiber reinforced plastic constituent; and wherein the lower jaw and the upper jaw comprise a die-forged steel, and the I-beam comprises an aluminum alloy.

18. The pipe wrench of claim 13, further comprising a lever coupled to the handle and extending through a channel of the web on the extension handle, the channel comprising a first continuous portion at a non-locking location and a second portion including a plurality of apertures at a locking location, wherein the second portion configured to lock the extension handle through the locking location of the channel, the continuous portion of the channel interconnecting the locking locations.

19. The pipe wrench of claim 18, wherein the handle further includes a side surface, and wherein the lever is coupled to the side surface at a proximal end of the handle such that the lever does not extend beyond a proximal edge of the handle reducing unwanted actuation of the lever.

20. A pipe wrench, comprising:

a head comprising an aperture;

a lower jaw coupled to the head, the lower jaw comprising a plurality of teeth that define a lower contact region;

an upper jaw partially extending through the aperture of the head, the upper jaw comprising a threaded portion and a plurality of teeth that define an upper contact region;

an actuator comprising threads engaged with the threaded portion of the upper jaw such that rotation of the actuator moves the upper contact region of the upper jaw relative to the lower contact region of the lower jaw;

a handle comprising a distal end portion adjacent the head and a proximal end portion opposite the distal end portion, the proximal end portion comprising a bore;

an extension handle comprising an I-beam configured to slidably extend or retract through the bore, the I-beam comprising flanges extending in a transverse direction on either side of a web;

a channel within the web of the extension handle, the channel comprising locking locations interconnected by narrow portions; and a locking button coupled to the handle and extending through the channel of the web, the locking button comprising a thick section configured to lock the extension handle through the locking location of the channel and a narrow section configured to traverse the locking button through the narrow portions of the channel.

21. The pipe wrench of claim 20, wherein the locking button comprises a first circular narrow section and a second circular thick section, wherein a first diameter of the first circular narrow section is less than a second diameter of the second circular thick section.

22. The pipe wrench of claim 20, wherein the locking button comprises an ovular narrow section and a circular thick section.

23. The pipe wrench of claim 20, further comprising a biasing member and an e-clip, the biasing member providing a force on the locking button to secure the locking button within the locking location of the channel.

* * * * *